US005727735A

United States Patent [19]

Baumann et al.

[11] Patent Number: 5,727,735

[45] Date of Patent: Mar. 17, 1998

[54] ROTARY ATOMIZER FOR A COATING ARRANGEMENT

[75] Inventors: Michael Baumann, Heilbronn; Harry Krumma, Bonninghelm; Frank Rupertus, Bletigheim-Bissingen; Rolf Schneider, Burgstetten; Kurt Vetter, Remseck, all of Germany

[73] Assignee: Behr Systems, Inc., Rochester Hills, Mich.

[21] Appl. No.: 514,115

[22] Filed: Aug. 11, 1995

[51] Int. Cl.[6] ..... B05B 15/02

[52] U.S. Cl. ..... 239/112; 239/124; 239/223

[58] Field of Search ..... 239/124, 125, 239/112, 223, 224, 225.1, 569, 582, 600

[56] References Cited

U.S. PATENT DOCUMENTS

| | | | |
|---|---|---|---|
| 3,224,680 | 12/1965 | Burnside et al. | 239/112 |
| 3,403,695 | 10/1968 | Hopkins | 239/112 |
| 4,380,321 | 4/1983 | Culbertson et al. | 239/112 |
| 4,605,168 | 8/1986 | Tachi et al. | 239/223 |
| 4,643,357 | 2/1987 | Culbertson et al. | 239/223 |
| 5,100,057 | 3/1992 | Wacker et al. | 239/223 |
| 5,106,025 | 4/1992 | Giroux et al. | 239/112 |
| 5,137,215 | 8/1992 | Degli | 239/223 |

*Primary Examiner*—Lesley D. Morris
*Assistant Examiner*—Lisa Ann Douglas
*Attorney, Agent, or Firm*—Howard & Howard

[57] ABSTRACT

The rotary atomizer described has a multiple-piece channel body, which is arranged coaxial to the rotational axis, for supplying coating material and flushing fluid to the bell plate and has three axial holes uniformly distributed eccentrically about the rotational axis. The first hole leads to a central nozzle and is connected to the second hole in the channel body, while the third hole is part of a channel that leads to an eccentric outlet flowing in the vicinity of the nozzle opening. A separate control valve is provided for each of the three channels.

7 Claims, 2 Drawing Sheets

ROTARY ATOMIZER FOR A COATING ARRANGEMENT

BACKGROUND OF THE INVENTION

The invention pertains to a rotary atomizer for a coating arrangement including a channel body having a plurality of channels each having a control valve associated therewith.

For known rotary atomizers of this type, used especially in electrostatic paint coating systems,e.g., for the production coating of motor vehicle bodies or other workpieces, the channel body is formed by means of a coaxial arrangement composed of an inner tube serving to supply the paint, in which the valve needle is seated on the rotational axis, and an outer tube that surrounds the inner tube, to form an annular gap serving as the paint return channel (European Patent No. 108,929). The return channel, even with a closed valve, permits the paint located in the paint supply tube to circulate or passes the paint back to a collecting system in order to flush the paint supply tube and the return tube in a forward-extending closed circulation. This prevents harmful emissions from the rotary atomizer, which now only needs to be cleaned in the section situated downstream from the paint valve, with only a limited amount of flushing material, for example, the air of a spraying chamber and the use of an arrangement to capture the mixture of residual paint and flushing agent. Said arrangement requires tedious cleaning from time to time becomes unnecessary. On the other hand, this known rotary atomizer does not allow a flushing agent from outside the two coaxial paint channels to enter the inside of the rotating bell plate or other spray elements. This is desirable, e.g., in order to briefly flush the bell plate without a substantial loss of paint, which is unavoidable if the bell plate is flushed via the paint channel. Moreover, a more effective and brief rinsing is possible with a separate flushing, since the flushing agent is not contaminated with paint.

A rotary atomizer with a channel body composed of a coaxial tube arrangement that uses the annular gap between the inner tube and outer tube for the purpose of leading flushing agent outside the paint channel formed by the inner tube directly into the rotating bell plate is known. This sacrifices, however, the possibility of recycling paint, with the associated advantages explained above. Rather, the entire amount of lacquer remaining in the paint tube must always be sprayed out through the bell plate into the spraying chamber for the purpose of cleaning the atomizer and also when changing colors. This results in a considerable loss of paint, a strain on the surroundings, and problems with disposal. In addition, cleaning the bell plate and, above all, changing colors results in undesirable delay times.

The underlying purpose of the invention is to indicate a rotary atomizer that enables a limited loss of paint, manages with little flushing agent and puts less strain on the surroundings, e.g., in a spraying chamber, and shortens the amount of time previously necessary for changing colors and/or flushing.

SUMMARY OF THE INVENTION

These problems are solved by a rotary atomizer for a coating arrangement in accordance with the present invention. The rotary atomizer includes a spray element attached to a rotating shaft, a drive motor for the spray element and a stationary channel body. The stationary channel body comprises two channels extending along a rotational axis of the atomizer. A first channel is joined to a line leading to an external connection for a coating material to be atomized and supplies the coating material to an outlet directed toward the spray element. A second channel is joined to a second line leading to an external connection and is connected to the first channel in the channel body. Each channel has a control valve associated therewith and controllable valve movements for the control valves. The stationary channel body also comprises a third axially extending channel joined to a third line leading to an external connection and is connected to an outlet facing the spray element in the vicinity of the outlet. The third channel is provided with a third control valve.

The third channel enables a flushing of the bell plate or the like, on the one hand, without having to first remove the paint from the paint supply channel for this purpose and accept its loss, and, on the other hand, without having to abandon the desirable recycling of paint. The functions of the known coaxial tube systems, previously only alternately possible, are combined and their previously mutually exclusive advantages are unified, namely, limited loss, limited strain on the surroundings and brief flushing or paint changing times.

In addition, new, previously unattainable operational functions can be realized by the presence of three channels. For example, the spray element can be supplied with, through the third channel, in lieu of a flushing agent, a coating material having a different color than that of the material supplied through the first channel or special elements can be used in one or several channels, e.g., mixing elements for two-component materials, where one or all channels may be switched in series according to their flow. More than three axially progressing channels may also be present in the channel body.

The channel body of the rotary atomizer according to the invention preferably has a cylinder body situated coaxial to the rotational axis, through which at least three holes pass, eccentric to the rotational axis and parallel to the same in order to form the channels. This configuration has the particular advantage that cylindrical holes serving as the paint channel allow a more ready flushing than the annular gap used to recycle paint in conventional coaxial tube arrangements, which has a much larger surface for an equal flow cross section. In addition, the holes enable a very stable, compact and space-saving construction of the channel body with three channels that are separate from one another.

These and other features of the present invention may be better understood from the following specification and drawings, of which the following is a brief description.

DETAILED DESCRIPTION OF A PREFERRED EMBODIMENT OF THE INVENTION

Figure 1:
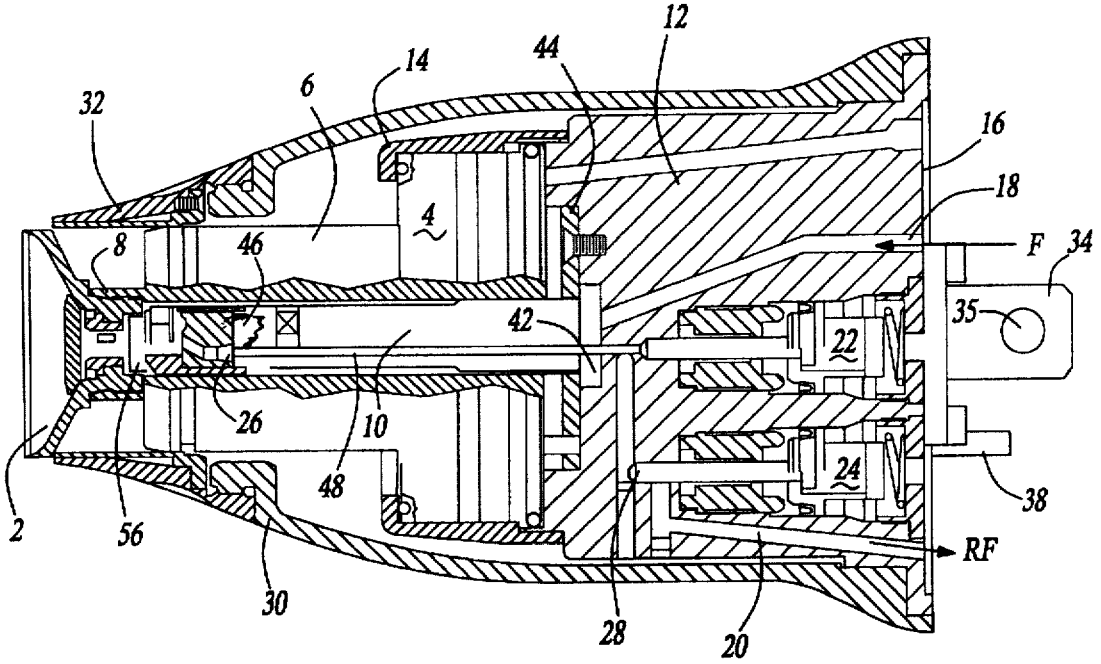
FIG. 1 is a cross-sectional view of a rotary atomizer according to the present invention.

The rotary atomizer represented in FIG. 1 is primarily composed of a bell plate unit (2), bearing unit (6) connected to a drive motor (4), e.g., in the form of an air turbine, for a hollow shaft (8) in the front end of which the bell plate unit (2) is threaded, a tubular channel body (10) arranged in a fixed manner within the hollow shaft (8) and coaxially passing through the bearing unit (6) and motor (4), which channel body (10), according to the operating mode, supplies the bell plate unit (2) with the coating material to be sprayed or with a flushing agent, and a valve unit (12) connected to the channel body (10). The drive motor (4) connected to the bearing unit (6) is fastened with a union nut (14) in an easily detachable manner to the valve unit (12). The valve unit (12) is essentially composed of a one-piece housing, through which a paint supply line (18) and a paint return line (20), as well as a flushing agent line (19) (FIG. 4), not visible in FIG. 1, lead from its exterior end face (16) to the channel body (10) located at its opposite interior end face. The housing of the valve unit (12) also contains controllable valve movements (22 and 24) for a primary needle valve (26) within the channel body (10) or for a control valve (28), accommodated in the housing of the valve unit, for opening and closing the paint return line (20). The valve unit (12) also comprises a third control valve for the flushing agent line and a valve movement for the same (not shown), the construction and arrangement of which can correspond to that of the control valve (28) and the movement of which can correspond to (24). For other embodiments of the invention, one or more of the control valves and/or their movements can also be located outside the rotary atomizer. A drive air line also leads through from the outer end face (16) of the valve unit (12) to the drive motor (4). Moreover, a rigid light guide rod (38) is arranged in the valve unit (12), the former serving for the transmission of light signals generated in a conventional manner according to the rpm.

The primary components of the rotary atomizer as mentioned above, hence, the bearing unit (6) with the drive motor (4) and the valve unit (12) are largely of a cylindrical shape and arranged coaxial to the rotational axis within an exterior cover (30), at the front end of which an air guide ring (32) is joined that terminates near the circumference of the rotating bell plate unit (2). The bell plate unit (2), serving as the spray element, is described in more detail in German Utility Model No. G 9,217,459, the disclosure of which is incorporated herein by reference.

The valve unit (12) holds all the remaining parts of the rotary atomizer and is fastened with an easily and quickly detachable connecting construction to an external mounting flange of the coating arrangement. A fastening pin, designated (34) and arranged on the valve unit, fits with its outer surface parallel to the longitudinal axis of the pin in an opening provided in the mounting flange and contains a radial through-hole (35) transverse to its longitudinal axis. A fastening peg (not shown) can be inserted to slide and move in the radial hole (35), the former, at one face end, engaging in the mounting flange in an interlocking manner and, at the opposite face end, engaging in an interlocking manner in the face end of a fastening screw that is offset in relation to the axis of the radial hole (35) and that passes through the mounting flange; the fastening screw presses against the fastening peg and is detachable from the same such that after detachment of the fastening screw, the rotary atomizer with its fastening pin (34) can be withdrawn from the opening of the mounting flange. The aforementioned rigid optical rod (38), cooperating with an optical coupler arranged in the mounting flange remains, when the atomizer is removed from the mounting flange, in the valve unit (12).

Figure 2:
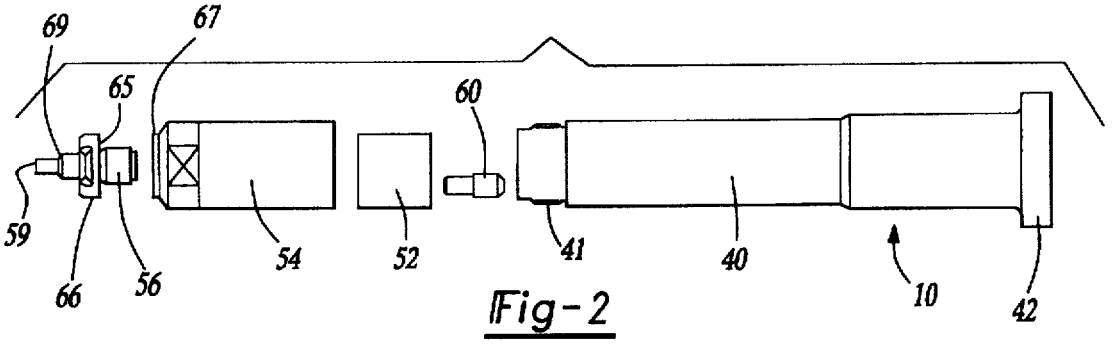
FIG. 2 is an exploded view of the individual parts of the channel body of an atomizer.

FIG. 2 shows, in exploded representation, the channel body (10) composed of different, essentially cylindrical, individual parts that can be screwed together and unscrewed. The longest part in an axial direction is the metallic cylinder (40) represented to the right in FIG. 2, the end flange (42) of which is fastened, with the help of a fastening plate (44) (FIG. 1) screwed to the housing of the valve unit (12), to the end face of the valve unit (12) facing the bell plate unit (2). The diameter of the section of the cylinder (40) situated in the vicinity of the end flange (42) is somewhat greater than that of the part joined thereon in the direction of the bell plate and fits with a limited clearance in the motor (4) or in its rotor connected to the hollow shaft (8).

Figure 3:
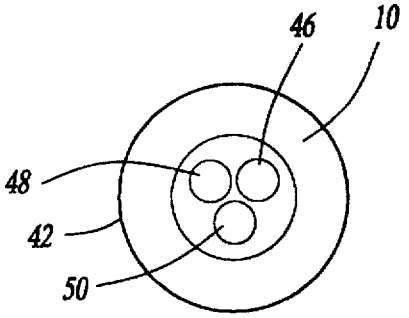
FIG. 3 is a side view of the right end, in FIG. 2, of the channel body.

Three holes (46, 48, and 50) extending through the cylinder (40), parallel to the rotational axis, are spaced uniformly and eccentric with respect to the rotational axis, as can be seen from FIG. 3 of the right end face, in FIGS. 1 and 2, of the cylinder (40). The openings of the three holes (46, 48, and 50) in the end face of the cylinder (40) supported by the housing of the valve unit (12) are aligned with associated openings of the lines (18, 19, and 20). Hole (46) allows the coating material to be supplied to the bell plate unit (2) via the first channel and is joined for this purpose to the aforementioned paint supply line (18) (FIG. 1) of the valve unit (12). The hole (48) allows the recycling of paint via the second channel, as described above, and is connected, for this purpose, at the end of the cylinder (40) facing the bell plate through an open space (47) (FIG. 5) between the holes (46 and 48) to the first channel, while the latter is joined in the valve unit (12) to the aforementioned paint return line (20). In contrast, the hole (50) forms a third channel through which a flushing agent flows, as described above, outside of the paint channels to the bell plate unit (2).

Joined to the cylinder (40) in an axial direction is a two-piece intermediate body, composed of a plastic inner body (52) serving primarily as a valve seat for the conventional needle valve (26) of the atomizer, and a generally hollow-cylindrical metallic outer body (54). The outer body (54) is screwed as a union nut onto outer thread (41) of the cylinder (40) and presses the removable inner body (52) seated in the outer body against the end face of the cylinder (40). The needle valve (26) is formed by the valve needle (23) inserted in the hole (48) and movable by the valve movement (22) within the valve unit (12); the head of this needle valve (23) is seated in a valve opening (53) of the inner body (52) coaxial to the hole (46).

A nozzle body (56), arranged coaxial to the rotational axis and to the channel body is screwed into the end (58) of the outer body (54) facing the bell plate and closed with the exception of the fluid channels; the nozzle (56) extends to the inside of the bell plate unit (2) as seen in FIG. 1.

Since the cylinder (40), the outer body (54) with removable inner body (52) seated therein and the nozzle body (56) are only screwed together, they can be effortlessly detached from one another as needed for inspection, cleaning or exchange, for example.

Figure 5:
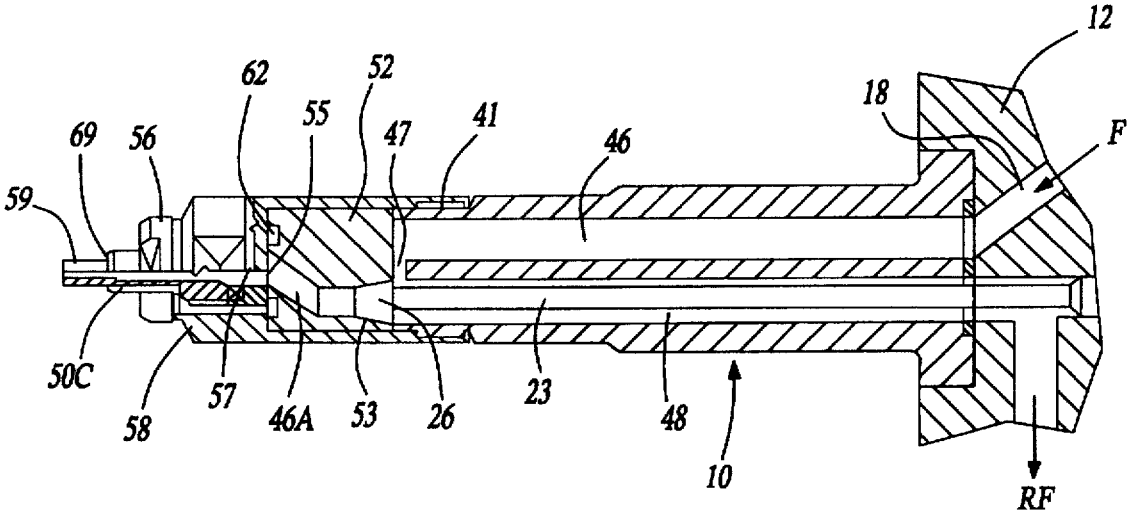
FIG. 5 is a cross-sectional view of the channel body along plane B—B in FIG. 3.

As seen in FIG. 5, an offset hole (46A) leads through the inner body (52) that serves as the valve seat, the former starting from the valve opening (53) as a continuation of the first channel to a central outlet (55) concentric to the rotational axis, which is connected to a hole (57) leading centrally through the bordering closed end (58) of the outer body (54) at which the central hole of the nozzle body (56) likewise joins concentric with respect to the rotational axis. The central outlet of the nozzle is designated (59).

Figure 4:
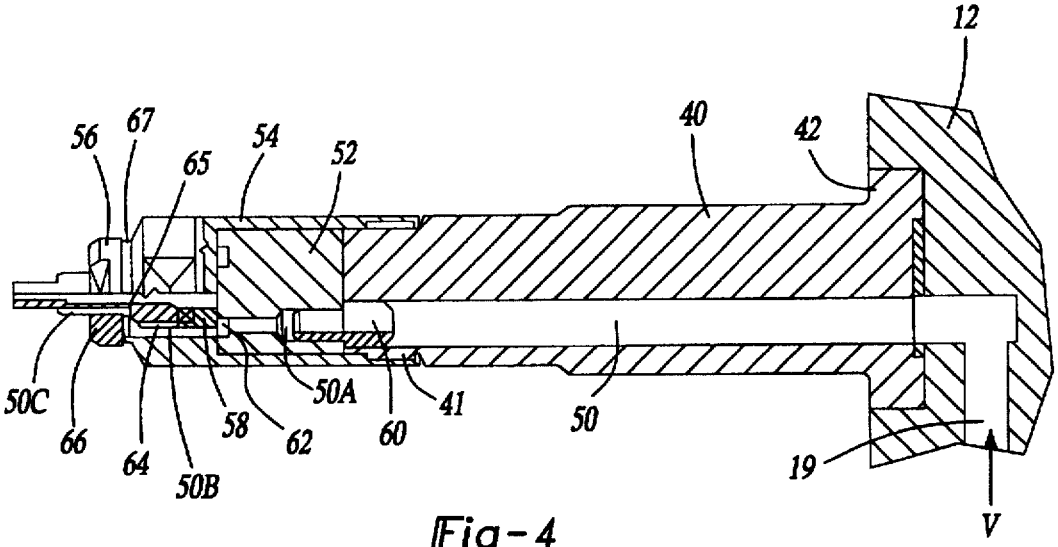
FIG. 4 is a cross-sectional view of the channel body along plane A—A in FIG. 3.

The progression of the third channel formed in the cylinder (40) by the hole (50) is represented in FIG. 4. Seated in the end of the hole (50) facing the bell plate is a hollow tubular peg (60), the other end of which extends into a hole (50A) in the inner body (52) flush with the hole (50), such that the tubular peg (60) connects the cylinder (40) or its hole in an interlocking manner to the inner body (52) serving as a valve seat. The tubular peg (60) is advantageously pressed in a fixed manner into the inner body (52) or into the cylinder (40). The hole (50A) progresses in an axial direction through the inner body (52) and flows into an annular recess (62) in the end face of the inner body (52) facing away from the cylinder (40). Connected to the annular recess (62) is an additional hole (50B) that, starting from the radial end face of the end (58) supported by the inner body (52) leads axially through the outer body (54) and flows into an annular space (64) formed between the outer body (54) and the nozzle body (56) that has been screwed on. The space (64) is bordered radially inward by a cylindrical part (65) of the nozzle body (56) located between the screwed portion threaded in the outer body (54) and a flange portion (66), and radially outward by an axially projecting annular border (67) of the outer body (54). The flange portion (66) is supported by the border (67) as seen in FIGS. 4 and 5. From the space (64), a hole leads through the cylindrical part (65) in a direction radial to the interior of the nozzle body (56) and to a hole (50C) passing through the nozzle body (56) and eccentric and parallel to the rotational axis. The hole (50C) is not connected to the central nozzle hole belonging to the first channel and flows into, as the end section of the aforementioned third channel, a radial end face (69) of the nozzle body in the vicinity of the central nozzle opening (59) parallel to the latter in the interior of the bell plate unit (2).

In operation, the coating material to be atomized flows through the aforementioned mounting flange and a (likewise not shown) line coupler in the paint supply line (18) of the valve unit (12), as shown by arrow (F), and reaches, by means of the first channel, namely, the holes (46, 46A, and 57), the valve opening (53) coaxial to the hole (48) of the return channel and the central hole of the nozzle body (56) in the bell plate unit (2). Coating material not reaching through the valve opening (53) flows back through the second channel, hence, through the open space (47) serving as a connecting path between the holes (46 and 48), the hole (48) and the paint return line (20) as well as through a line coupler (not shown) in the mounting flange back to the coating arrangement, as shown by arrow (RF). Progressing separately from this until it flows into the bell plate unit (2) is the third channel, e.g., for a dilution fluid) from the mounting flange of the coating arrangement according to arrow (V) (FIG. 4) through the flushing agent line (19) in the valve unit (12), the hole (50), the tubular peg (60) and the holes (50A, 50B, and 50C). All three channels can be respectively released and blocked by means of their associated valves, hence, the needle valve (26), the paint return control valve (28) in the valve unit (12) or the third control valve (not shown) likewise accommodated in the valve unit (12).

The functions described can also be changed within the scope of the invention. For example, in lieu of the recycling function, the lines (18 and 20) and the paint channels corresponding to the holes (46 and 48) create the possibility of optionally routing two different coating materials, with the flushing agent function being preserved in the third channel. Another possibility exists in, in lieu of the flushing agent function, that two coating materials of different colors may be optionally supplied through two channels and using the third channel for return, where a connection would be needed in the channel body between all three holes. The possibility moreover exists of separately supplying two components of a coating material to be mixed in the channel body through lines (18 and 20), where the flows of two or more channels of the channel body can be switched in series and/or the flushing agent function of the aforementioned third channel can be preserved. So far as structural alterations of the embodiment described are required, the parts of the detachable channel body to be altered can be exchanged for different corresponding parts.

A preferred description of this invention has been disclosed; however, a worker of ordinary skill in the art would recognize that certain modifications come within the scope of this invention. For that reason, the following claims should be studied to determine the true scope and content of this invention.

We claim:

1. A rotary atomizer for a coating arrangement comprising a spray element mounted on a rotating shaft, a drive motor for said spray element, and a stationary channel body comprising a first and second channel extending along a rotational axis of said atomizer, said first channel providing fluid communication first between a line leading to a first external connection for a coating material to be atomized and a first outlet directed toward the spray element, said second channel providing fluid communication between a second line leading to a second external connection and said first channel in the channel body to provide a paint recycling connection, a control valve associated with each of said first and second channel and controllable valve movements provided for each of said control valves, characterized in that said stationary channel body further comprises a third axially extending channel, providing fluid communication between a third line leading to a third external connection of a cleaning fluid and a second outlet facing the spray element adjacent said first outlet, and a controllable third control valve for said third channel; and said channel body has a cylinder situated coaxial to said rotational axis, through which three bores lead, extending parallel to the rotational axis in order to form said first, second and third channels, of which at least two of said three holes are situated non-coaxial to said rotational axis;

said three holes are spaced uniformly from one another eccentric to the rotational axis;

said channel body including an intermediate body adjacent said cylinder on a side facing said spray element, into which said first channel leads to a central opening connected to an outlet nozzle for the coating material, and in that at least two holes of the cylinder are connected to one another at a boundary between said cylinder and said intermediate body or in the intermediate body; and a passage leading from said eccentric hole corresponding to said third channel through said intermediate body to an eccentric outlet of said intermediate body, and in that said channel body has a nozzle body on said intermediate body, on a side facing said spray element, said intermediate body forming an outlet nozzle for the coating material fed by said central outlet of said intermediate body, and in that said third channel leads from said eccentric outlet of said intermediate body to the outlet of said third channel located eccentric to said outlet nozzle in an end face of the nozzle body facing the spray element.

2. A rotary atomizer as recited in claim 1, characterized in that the channel body includes an intermediate body adjacent said cylinder on a side facing said spray element, into which said first channel leads to a central opening connected to an outlet nozzle for the coating material, and in that at least two holes of the cylinder are connected to one another at a boundary between said cylinder and said intermediate body or in the intermediate body.

3. A rotary atomizer as recited in claim 1, characterized in that the nozzle body is connected in a detachable manner, by means of threads, to the intermediate body.

4. A rotary atomizer as recited in one of claim 3, characterized in that the cylinder and the intermediate body are detachable from one another and are connected to one another by means of threads.

5. A rotary atomizer as in one of claim 4, characterized in that the intermediate body is a two-piece unit and is composed of a cylindrical inner body serving as a valve seat and a generally hollow cylindrical outer body screwed to the cylinder, and in that the third channel in the inner body leads from a tubular peg connecting an associated eccentric hole of the cylinder in an interlocking manner to the inner body to an annular recess in an end face of the inner body facing away from the cylinder, and that the outer body, starting from a radial surface adjacent the inner body contains an additional hole connected to the annular recess, that flows into a space formed between the outer body and the nozzle body, which is connected to the section of the third channel leading through the nozzle body.

6. A rotary atomizer as recited in claim 5, characterized in that the three valves and their respective valve movements are assembled into a valve unit of the rotary atomizer connected in a detachable manner to the channel body.

7. A rotary atomizer as recited in claim 6, characterized in that the channel body is screwed in a detachable manner along an end facing away from the spray element to a housing of the valve unit, where an end surface perpendicular to the rotational axis, into which the three holes flow is supported by an end face of the valve unit, in which said lines flow into said holes of corresponding locations.

* * * * *